United States Patent [19]

Gladden, Jr. et al.

[11] Patent Number: 5,011,416

[45] Date of Patent: Apr. 30, 1991

[54] CABLE CONNECTING DEVICE

[75] Inventors: Robert H. Gladden, Jr., Norcross; Phillip M. Thomas, Lake City, both of Ga.

[73] Assignee: AT&T Bell Laboratories, Murray Hill, N.J.

[21] Appl. No.: 503,360

[22] Filed: Apr. 2, 1990

Related U.S. Application Data

[62] Division of Ser. No. 358,991, May 26, 1989, abandoned.

[51] Int. Cl.[5] ..... H01R 13/648

[52] U.S. Cl. ..... 439/98; 174/78

[58] Field of Search ..... 439/98, 99, 92, 100; 174/6, 78

[56] References Cited

U.S. PATENT DOCUMENTS

| | | | |
|---|---|---|---|
| Re. 28,468 | 7/1975 | Baumgartner et al. | 439/99 |
| 3,499,972 | 3/1970 | Smith | 439/426 |
| 3,787,797 | 1/1974 | Kurz | 174/78 |
| 3,924,920 | 12/1975 | Moscioni et al. | 439/781 |
| 3,963,299 | 6/1976 | Thompson et al. | 439/99 |
| 4,310,209 | 1/1982 | Fleming et al. | 439/99 |

FOREIGN PATENT DOCUMENTS

| | | | |
|---|---|---|---|
| 2713247 | 9/1978 | Fed. Rep. of Germany | 439/98 |
| 500155 | 2/1939 | United Kingdom | 174/78 |

*Primary Examiner*—Gary F. Paumen

*Attorney, Agent, or Firm*—E. W. Somers

[57] ABSTRACT

A device (20) for connecting a ground wire (66) to a metallic portion of a cable (30) includes a first cable engagement portion (22) having a bond shoe (42) which is adapted to be engaged with a metallic cable shield (34). The bond shoe has an upstanding portion (52) projecting therefrom and adapted to be secured to an upstanding portion (56) of a second cable engagement portion (24). A plate (58) of the second cable engagement portion is adapted to become engaged with and to become secured to a portion of a plastic jacket (36) of the cable which encloses the metallic shield. A bonding block (26) having two bores each adapted to receive an end portion of a ground wire is secured to the two upstanding portions. Wire-like strength members (38—38) of the cable may be terminated in a clamped manner between the upstanding portions of the second cable engagement portion and the bonding block. Advantageously, the connecting device is independent of any closure in which it may be disposed.

5 Claims, 5 Drawing Sheets

CABLE CONNECTING DEVICE

This is a division of application Ser. No. 07/358,991 filed May 26, 1989, now abandoned.

TECHNICAL FIELD

This invention relates to a cable connecting device. More particularly, the invention relates to a device which is connectable to a metallic shield of a metallic conductor or optical fiber communications cable and/or to metallic strength members thereof to facilitate grounding of the cable.

BACKGROUND OF THE INVENTION

Communications cable systems normally include a plurality of discrete cable lengths which are joined together at splice locations and which are joined to other apparatus at terminal points. Each of these discrete cable lengths comprises a multi-conductor or optical fiber core that may be enclosed in a relatively thin metallic shield, and an outer plastic jacket. The shield typically takes the form of a metallic tape that is wrapped longitudinally about the core to form a tubular member having an overlapped seam.

A metallic shield in communications cables performs a variety of important functions. Some of these are the protection of craftspersons from injury and of equipment from damage if a live power line should fall and contact the cable, protection from inductive pickup due to power line voltage, protection from lightning, and suppression of radio frequency pickup. The metallic shield also provides physical protection of the cable core and acts as a barrier to moisture penetration.

To obtain effective shielding from power line-induced noise, for example, shield continuity must be provided throughout the cable. At splice locations where the cable jacket and shield are removed to expose the individual conductors, it becomes necessary to provide for continuity of the shield across the splice locations for proper electrical protection of the conductors. Moreover, it is not uncommon for a cable shield to be earth grounded. Connection to the cable shield at splice locations is generally accomplished with a shield clamping device which is referred to in the art as a bond clamp or bonding device. Bonding devices on opposite sides of the splice are interconnected.

One prior art bonding device for use in providing electrical cable shield continuity clamps directly onto the relatively thin shield; however, such a device may tear or damage the thin conductive shield and thereby lose its effectiveness. Another bonding device, U.S. Pat. No. 3,499,972, includes a base which fits beneath the shield and which has a stud protruding outwardly through a slit which is cut in the shield and in an overlying outer jacket. An outer bridge is mounted on the stud to clamp the shield and jacket between the base and the bridge.

Still another cable shield connector comprises an inner plate having an upstanding tab on one end thereof, and an outwardly protruding threaded stud spaced from the tab. The opposite end of the inner plate is slipped under the shield until the stud abuts the ends of the shield and jacket and and an outer plate is positioned on the stud over the jacket and forced toward the inner plate by a nut which is turned along the stud. The outer plate first contacts the upstanding tab of the inner plate and tends to pivot thereabout causing the othere ends of the plates to tightly clamp the shield and jacket therebetween. Such a cable shield connector is disclosed and claimed in U.S. Pat. Re. No. 28,468 which was issued on Jul. 8, 1975 in the names of R. G. Baumgartner et al.

Often times, the bonding device, as it is termed in the art, is disposed within the confines of a closure. Desirably, the sought-after connecting device is closure independent, that is the connecting device is not structured to conform to any particular closure structure but rather is capable of being used in a multitude of closures.

Also, a further problem exists with respect to optical fiber cables. In that art, it is not uncommon to find some manufacturer's cables which include a plurality of longitudinally extending strength members which are made of a metallic material. If such strength members are included in a cable to be spliced, they too must be connected electrically to the ground connection which is carried across the splice. The prior art bonding devices described herein are not capable of establishing electrical connections with metallic strength members of cable.

Clearly, there is a need for a connecting device which is used to establish electrical continuity of a shield across a cable splice. Also, the sought after device should be capable of connecting electrically and mechanically to one or more strength members of a cable sheath system. Seemingly, the prior art does not show a connector which fulfills these needs.

SUMMARY OF THE INVENTION

The foregoing problems of the prior art have been overcome by the cable connecting devices of this invention. A device for connection to a cables includes a first cable engagement portion for being engaged with and secured to an interior portion of the cable. The first cable engagement portion includes two arcuately shaped portions, one of which includes an upstanding portion, which cooperate to clamp an interior portion of the cable therebetween. A second cable engagement portion is adapted to become engaged with a plastic jacket of the cable which encloses the interior portion of the cable. The second cable enagement portion includes an upstanding portion which is adapted to become secured to the upstanding portion of the first cable engagement portion. A ground-wire receiving portion of the device is adapted to become secured to at least one of the upstanding portions.

An interior one of the arcuately shaped portions of the first cable engagement portion is adapted to engage a shield of the cable and has a post to facilitate securing the other arcuately shaped portion thereto. Strength member wires of the cable may be terminated between the upstanding portion of the second cable engagement portion and the ground-wire receiving portion.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
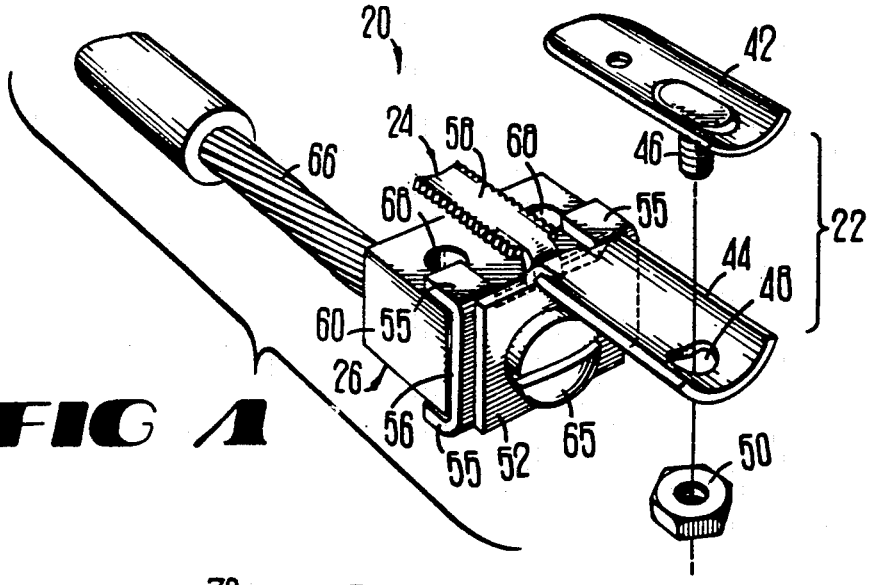
FIG. 1 is a perspective view of a preferred embodiment of a cable connecting device of this invention.
Figure 2:
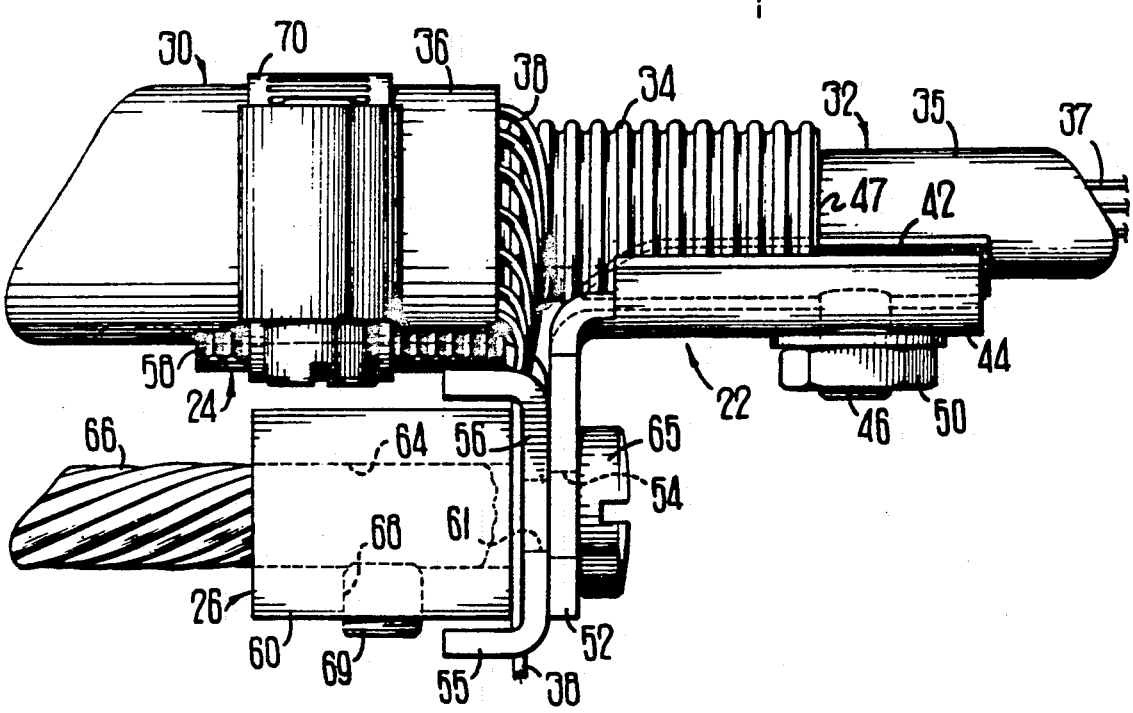
FIG. 2 is an elevational view of the device of FIG. 1.
Figure 3:
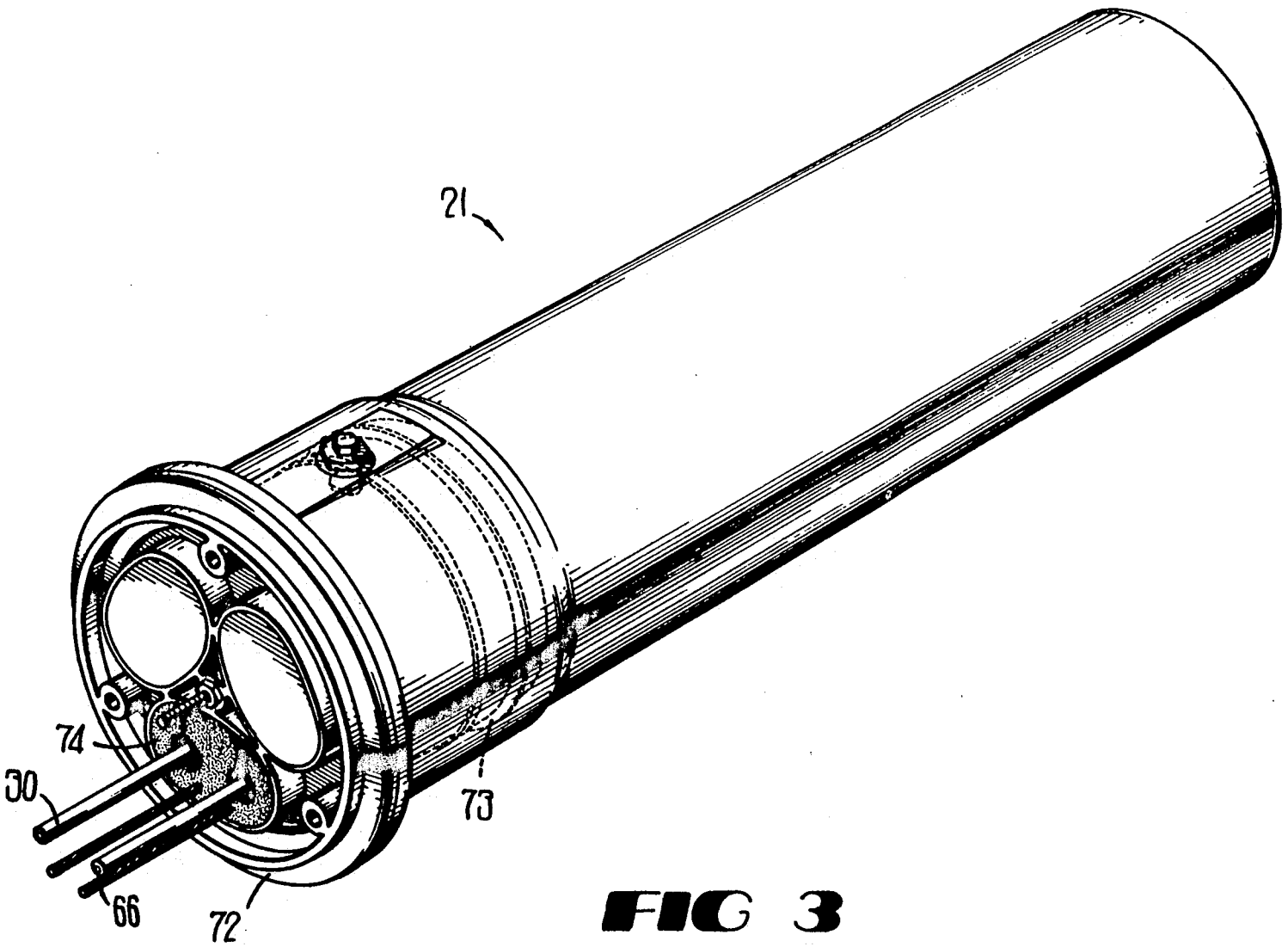
FIG. 3 is a perspective view of a closure in which the device of FIG. 1 may be used.

Referring now to FIGS. 1 and 2, there is shown a preferred embodiment of a cable connecting device of this invention which is designated generally by the numeral 20. The connecting device 20 is adapted to be used, for example, in a cable closure such as that shown in FIG. 3 and designated generally by the numeral 21. The cable connecting device 20 includes a first cable engagement portion 22, a second cable engagement portion 24 and a ground wire-receiving portion or bonding block 26.

The cable connecting device 20 is adapted to be connected to a cable (see FIGS. 2 and 3), for example, which includes a core 32, a corrugated metallilc shield 34 and a plastic jacket 36. For a metallic conductor cable, the core 32 comprises one or more twisted pairs of insulated metallic conductors (not shown) whereas for an optical fiber cable, the core comprises one or more coated optical fibers 37—37. Also, typically in an optical fiber cable, the optical fibers are enclosed in a core tube 35 which is made of a plastic material and which is enclosed by the shield and the jacket. Further, the cable 30 typically includes one or more longitudinally extending metallic strength members 38—38 which are disposed between the shield 34 and the jacket 36.

The connecting device 20 of this invention is adapted to carry electrical continuity across a splice location, for example, where two of the cables 30—30 are spliced to each other and/or to service distribution wires. Also, the device 20 is capable of being used to establish a connection from the shield of a cable to ground and to terminate strength members of the cable.

The first cable engagement portion 22 includes two arcuately shaped portions 42 and 44 which cooperate to establish electrical engagement with the cable shield 34. The portion 42 commonly is referred to as a bond shoe and the portion 44, as a bond plate. The bond shoe 42extends longitudinally along a length of the cable from which the jacket has been removed and has a transverse cross sectional configuration which is such that it conforms generally to the cross sectional curvature of a range of cable shields. The bond shoe 42 is inserted between the shield 34 and the core 32 until a threaded post 46 which is attached to and which projects radially outwardly from the bond shoe in place on a cable engages a peripheral end 47 of the cable shield.

As is seen in FIGS. 1 and 2, the bond plate 44 of the first cable engagement portion also is arcuately shaped in a transverse direction and includes an opening 48 through which the post 46 of the bond shoe 42 is adapted to extend. A nut 50 is turned onto the post 46 to secure the bond plate 44 to the bond shoe 42 with the cable shield 34 clamped therebetween.

The bond plate 44 also includes an upstanding portion 52 having a slotted opening 54 formed therein. The upstanding portion 52 is adapted to become secured to an upstanding portion 56 of the second cable engagement portion 24.

Figure 4:
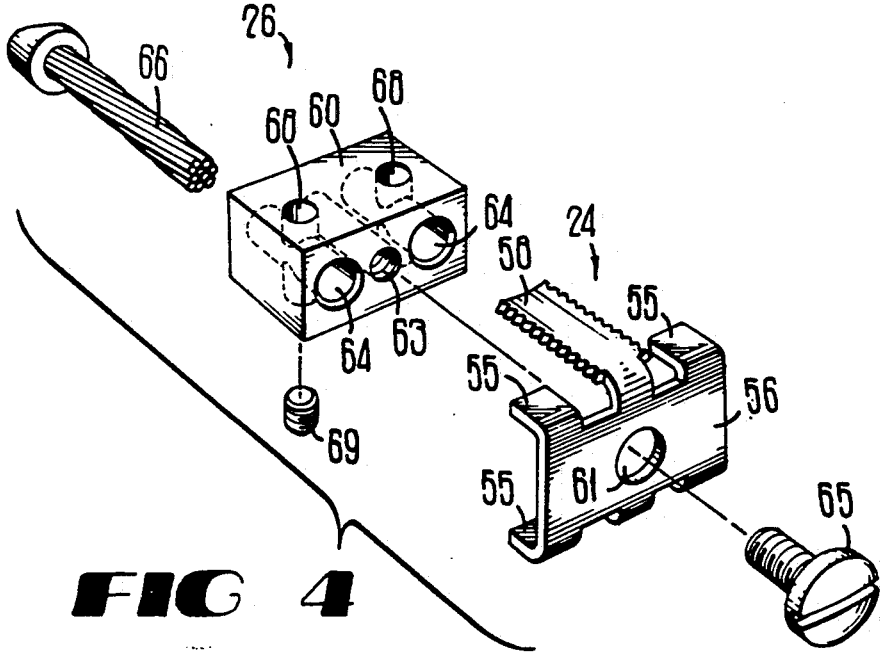
FIG. 4 is a perspective view of an alternate embodiment of the device of FIG. 1.
Figure 5:
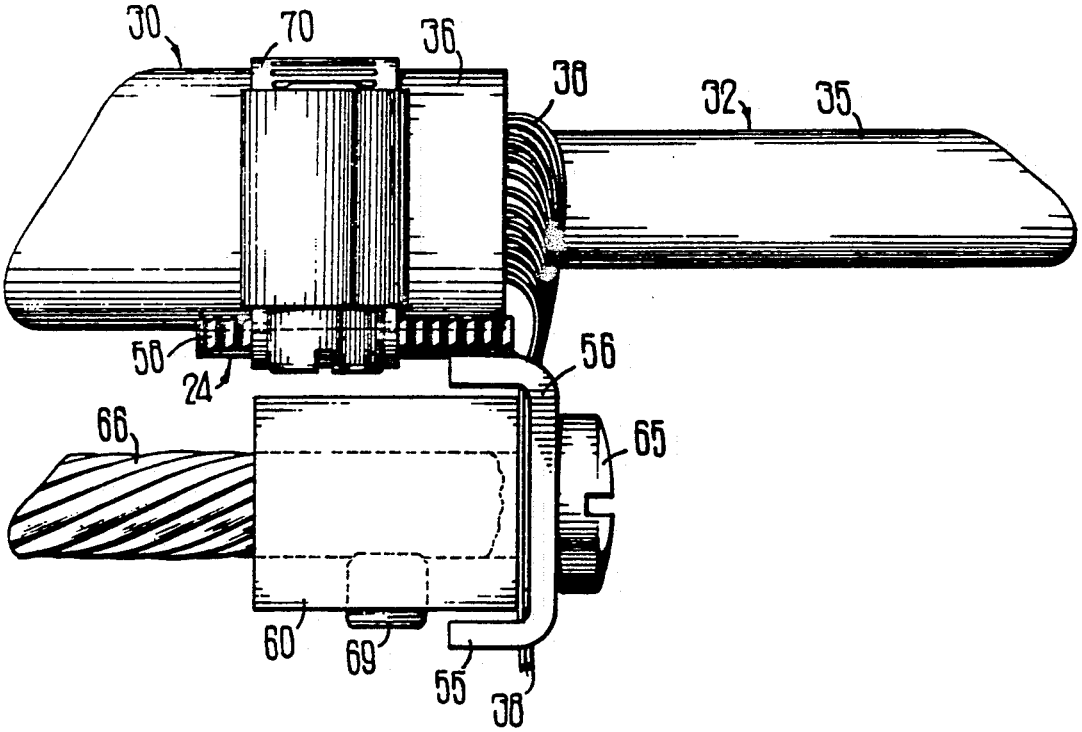
FIG. 5 is an elevational view of the device of FIG. 4.

Referring again to FIGS. 1 and 2, it is seen that the upstanding portion 56 of the second cable engagment portion 24 is formed integrally with a shoe plate 58 which is adapted to extend longitudinally along a portion of the jacketed portion of a cable (see also FIGS. 4 and 5). The portion 58 has an arcuately shaped configuration in a direction transverse of the longitudinal axis of the cable which is capable of engaging the jacket 36 of any of a range of cable sizes. Also, longitudinal edge portions of the portion 58 are serrated or otherwise formed to facilitate a coupling to the plastic of the cable jacket. Further, the free end of the upstanding portion 56 as well as a portion adjacent to the shoe plate 58 is formed to provide a plurality of spaced fingers 55—55. Further, the fingers are turned to extend generally parallel to the shoe plate 58.

Lastly, the ground wire-receiving portion or bonding block 26 is adapted to be received between the fingers 55—55 at the free end of the upstanding portion 56 and the fingers adjacent to the shoe plate 58 and to be spaced from the shoe plate 58 of the second cable engagement portion 24 along a radial line extending from the cable. The bonding block 26 includes a housing 60 which includes a threaded bore 63 (see FIG. 4) for receiving a fastener 65 that extends through the slotted opening 54 in the upstanding portion of the first cable engagement portion 22 and an opening 61 in the upstanding portion 56 of the second cable engagement portion.

Should a cable to which the device is connected include strength members, the strength members may be terminated by routing them through notches formed between adjacent fingers of the upstanding portion 56. The fingers 55—55 are spaced apart sufficiently to receive a plurality of small gauge strength members. Or, one or a relatively low number of larger diameter strength members may be received between the fingers. When the fastener 65 is turned into the bore 63, strength members 38—38 disposed between the fingers 55—55 of the upstanding portion 56 are clamped together between the upstanding portion 56 and the housing 60 of the bonding block 26. Also, the two cable engagement portions and the housing 60 are secured together.

The housing 60 also includes two bores 64—64 which extend parallel to the shoe plate 58 when the housing is secured to the second cable engagement portion 24. Each bore 64 is adapted to receive an end portion of a ground wire 66. A threaded passageway 68 communicates with each bore and is adapted to receive a set screw 69 to hold the ground wire in its bore.

Further as can be seen, the housing 60 when assembled to the first and second cable engagment portions is spaced from the shoe plate 58. This allows an adjustable clamping band 70 to be disposed about the cable 30 and passed between the shoe plate 58 and the housing 60 to hold the device 20 secured to the cable.

In using the cable connecting device 20, a craftsperson causes a cable 30 which is to be spliced to be routed though a grommet 74 (see FIG. 3) in an end plate 72 whereafter sheath components are removed to expose the metallic shield 34 of each. Then the craftsperson moves a clamping band 70 of a kit of parts over an end portion of the cable 30 from a portion of which the sheath system has been removed and from a portion of which the jacket has been removed. The strength member wires 38—38 of the cable are separated into two groups and turned at right angles to a longitudinal axis of the cable. Then the shoe plate 58 of the second cable engagement portion 24 is placed into engagement with the cable jacket 36 adjacent to the exposed shield. The shoe plate 58 is positioned so that the notches between the fingers 55—55 in the upstanding portion 56 receive the strength member wires of the strength member system. Afterwards, the clamping band 70 is positioned over the shoe plate 58 of the second cable engagement portion and tightened to secure the shoe plate to the cable 30.

For a cable having a corrugated shield, the bond shoe 42 of the first cable engagement portion is moved slidably between the corrugated metallic shield 34 and the core tube 35 until the stud 46 abuts a peripheral edge 47 of the shield. The bond plate 44 is positioned adjacent to the shoe plate to cause the opening 48 in the bond plate to be aligned with the stud 46 upstanding from the bond shoe. The nut 50 is turned along the threaded stud 46 to cause the shield to be secured compressively between the bond shoe 42 and the bond plate 44. This also establishes electrical engagement between the first cable engagement portion 22 and the shield 34.

At this time, the craftsperson may find it necessary to adjust the location of the second cable engagement portion along the cable 30. This is done to cause the upstanding portion 56 to be disposed adjacent to the upstanding portion 52 of the first cable engagement portion 22.

Afterwards, the bonding block 26 with the set screw 69 directed away from the cable is oriented so that the strength member wire bundles are disposed between the bonding block and the upstanding portion 56 of the second cable engagement portion 24. A fastener 65 is inserted through the slotted opening 54 in the upstanding portion 52 of the bond plate 44 and the upstanding leg 56 of the second cable engagement portion into the bore 63 of the housing 60. This secures together the two cable engagement portions 22 and 24 and causes the shield and the strength members to be connected together and to the device 20 electrically.

Shown in FIGS. 4 and 5 is an alternate embodiment of the cable connecting device 20 to be used with a cable which has no shield but which includes strength members. As can be seen, because of the absence of a shield, it is not necessary to provide the bond shoe 42 and the bond plate 44. Only the second cable engagement portion 24 is secured to the cable jacket 36 by a clamping band 70. The strength member wires 38—38 of the cable 30 are turned to be about 90° to the longitudinal axis of the cable and disposed between the bonding block 26 and the upstanding leg 56. As before, the strength members 38—38 are received in notches formed between the fingers 55—55 of the upstanding portion 56 of the cable engagement portion 24. Then a fastener 65 is turned through the opening 61 in the upstanding leg 56 of the second clamp and into the threaded bore 63 in the housing 60. The fastener 65 is turned to secure together the upstanding leg 56 and the bonding block 26 with the strength member wires 38—38 therebetween.

Figure 6:
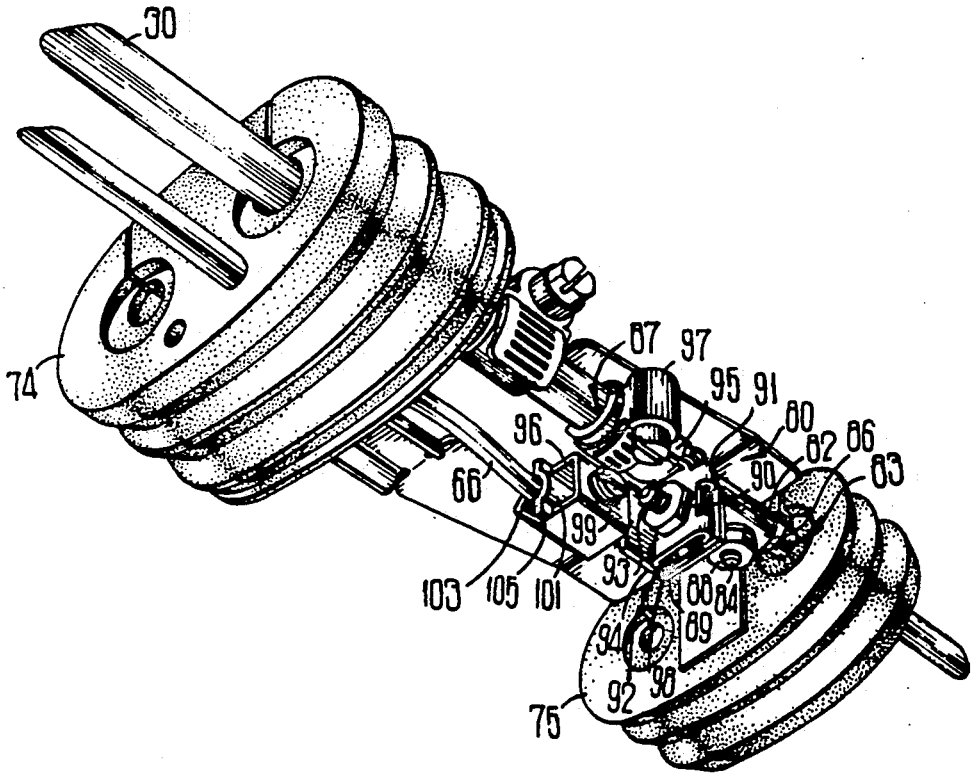
FIG. 6 is a perspective view of an alternative embodiment of a cable connecting device.
Figure 7:
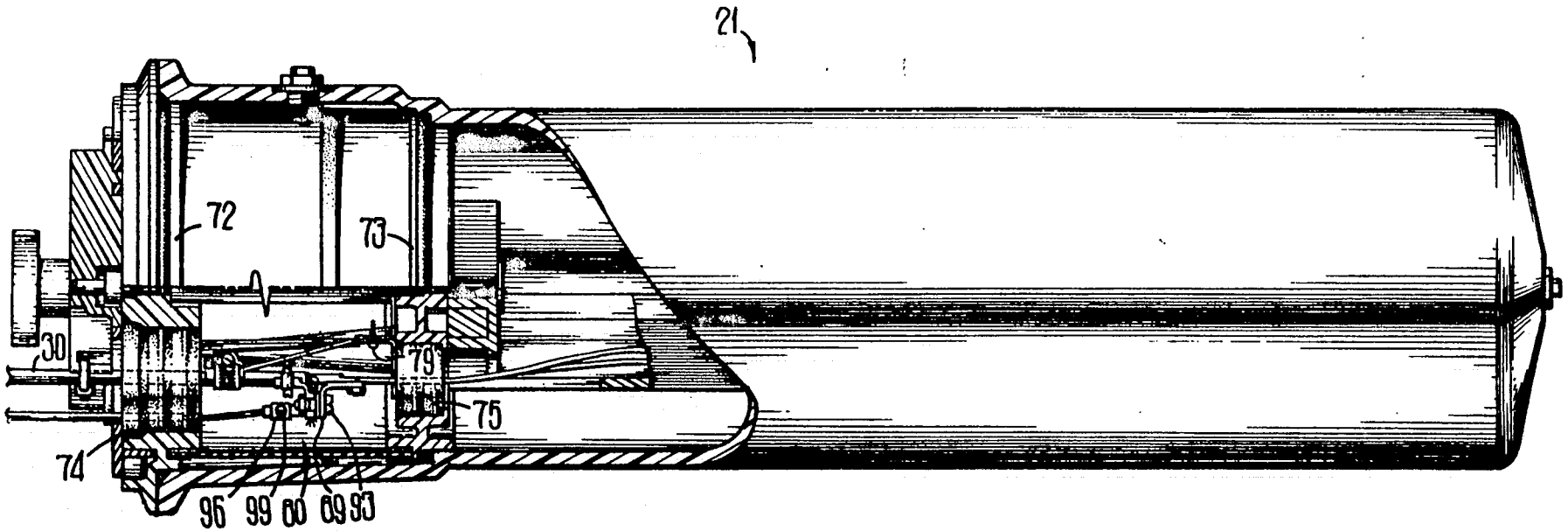
FIG. 7 is an elevational view of the device of FIG. 6 within a closure.

Going now to FIGS. 6 and 7, there is shown an alternative embodiment of the cable shield connecting device of this invention. Disposed between the end plate 72 and an inner end plate 73 of the closure 21 is a bonding means 80. The bonding means 80 is adapted to engage that portion of the cable between the end plates 72 and 73 to establish an electrical connection with a metallic shield of a cable 30. The cable 30 which is to be spliced to another cable is caused to extend through grommets in the end plate 72 whereafter sheath components are removed to expose the metallic shield 34 of each. The bonding means 80 is attached to each cable to establish an electrical connection with the metallic shield of each after which a grounding wire 66 is connected to the bonding means and routed out of the closure 20 through an opening in one of the grommets. The metallic shield is removed from an additional length of each cable to expose its core tube 35. The core tube 35 is caused to be routed through the aligned opening in a grommet 75 of the end plate 73 to the interior of the closure to facilitate the splicing of optical fibers witin the core tube to other optical fibers.

Of course, should either cable or both not include a metallic shield, bonding means between the end plates 72 and 73 may still be needed to provide grounding for metallic strength members. The bonding of any metallic portions of the cables to be spliced in the arrangement of FIG. 3 may be performed between the end plates, that is, in a different portion of the closure 21 than that in which the splicing of the optical fibers is performed.

Each exposed portion of a metallic shield 34 which extends past a plastic jacket is caused to be disposed between a bond shoe 82 of a first cable engagement portion 83 having a threaded stud 84 upstanding therefrom and an outer bond plate 86. The bond plate 86 is held to the shield by a nut 88 which is turned onto the threaded stud 84. The outer bond plate 86 includes a turned portion 89 which is secured to a turned portion 91 of a second cable engagement portion 87 by a fastener 93 and a nut 90. The turned portion 91 extends from a curved plate 95 which is secured to the cable jacket 36 by an adjustable clamping band 97. Longitudinal edge portions of the plate 95 are provided with teeth which are adapted to become embedded in the cable jacket.

Strength member wires, if any, of the cable disposed between the shield and the jacket, for example, may be secured to the turned portion 91 of the second cable engagement portion. This is accomplished by causing arms 92—92 of the turned portion 91 to be retroflexed to form U-shaped portions in clamping engagement with the strength members 38—38.

Disposed between the two turned portions 89 and 91 is an end plate 94 of an L-shaped grounding portion 98. Another leg 101 of the L-shaped portion 98 is secured within a barrel 96 by a set screw 99. Disposed in engagement with the leg 101 within the barrel 96 is a bared end portion of a ground wire 66 which extends through the outer grommet 74 and which external to the closure may be covered with a plastic jacket. The ground wire 66 is suitably grounded externally of the closure. As can be seen in FIG. 6, the bared end of the ground wire is captured between the end plate 94 and a V shaped portion 103 of the barrel 96. Also, it should be observed from FIG. 6 that the other leg 101 of the L-shaped grounding portion 98 is provided with ears 105—105 to prevent inadvertent disassembly of the other leg 101 and the barrel before the set screw 99 has been turned to secure a ground wire 66 in the barrel.

In use of the bonding means 80, a craftsperson causes the clamping band clamp 97 to be moved over the end portion of the cable from which jacketing material and shielding have been removed. Then a curved plate 95 of a second cable engagement portion 87 is caused to engage the cable jacket and positioned to cause the turned portion 91 to be disposed adjacent to the exposed shield. The clamping band 97 is moved over the curved plate 95 and tightened to secure the curved plate to the cable.

Strength member wires 38—38 of the cable 30 are caused to be disposed adjacent to the turned portion 91 of the second cable engagement portion. Then the arms 92—92 are caused to assume a retroflexed configuration to secure the strength member wires to the turned portion 91.

Then the bond shoe 82 is inserted between the shield and the cable core until the threaded stud 93 abuts the peripheral face of the shield. The bond plate is assembled to the bond shoe to cause the upstanding stud to protrude through the opening in the bond plate. Then a nut is turned over the stud to secure together the assembly of the bond shoe and the bond plate with the shield therebetween.

Afterwards, the craftsperson causes an end plate 94 of the ground wire receiving portion to be disposed between the turned portion 91 of the second cable engagement portion and the upstanding portion 89 of the bond plate 86 of the first cable engagement portion 83. A fastener 93 is turned through openings in the upstanding portions 91 and 89 and the end plate 94 and a nut turned thereon to secure them together.

Then the craftsperson inserts an end portion of a ground wire 66 into the barrel 96 between the other leg 101 and the V-shaped portion of the barrel. The set screw 99 is turned to secure the ground wire therein and complete the electrical connection among the shield, the strength members and the ground wire 66.

It is to be understood that the above-described arrangements are simply illustrative of the invention. Othr arrangements may be devised by those skilled in the art which will embody the principles of the invention and fall within the spirit and scope thereof.

We claim:

1. A device which is connectable to a cable and which is adapted to terminate strength member wires of said cable, said device including:

cable engagement clamping means for being secured to a cable jacket, said clamping means including a portion adapted to become engaged with and clamped to an outer surface of the plastic jacket of the cable and further including an upstanding portion which is substantially perpendicular to a longitudinal axis of the cable; and bonding block means adapted to be secured in engagement with said upstanding portion of said clamping means and spaced from said portion of said clamping means which engages the cable jacket along a radial line extending from the cable for securing strength members of the cable which are disposed between said upstanding portion and said bonding block means, said bonding block means also including at least one passageway for receiving an end portion of a ground wire.

2. The device of claim 1, wherein said cable engagement clamping means includes an arcuately formed plate adapted to engage the cable jacket, and clamp means adapted to be disposed about and in engagement with said arcuately formed plate and the cable to secure said arcuately formed plate to the cable.

3. The device of claim 2, wherein longitudinal edges of said arcuately formed plate are serrated.

4. The device of claim 1, wherein said upstanding portion of said cable engagement clamping means includes a plurality of fingers which overhang said bonding block means, said fingers disposed to be spaced apart to receive end portions of cable strength members therebetween.

5. The device of claim 4, wherein said fingers are spaced apart sufficiently to receive a plurality of strength members of cables to which said device is expected to be connected.

* * * * *